United States Patent [19]

Matsumoto

[11] 4,377,110

[45] Mar. 22, 1983

[54] AUTO-CONTROL EQUIPMENT OF HULL-REMOVING ROLL IN RICE-HULLING MACHINES

[75] Inventor: Hajime Matsumoto, Matsuyama, Japan

[73] Assignee: Iseki & Co., Ltd., Japan

[21] Appl. No.: 219,991

[22] Filed: Dec. 11, 1980

[51] Int. Cl.[3] ..... B02B 3/04

[52] U.S. Cl. ..... 99/489; 99/523; 99/524; 99/618; 99/620; 100/47; 241/37

[58] Field of Search ..... 99/486, 488, 489, 492, 99/523, 524, 618–622, 574, 575; 241/37; 100/47

[56] References Cited

U.S. PATENT DOCUMENTS

| | | | |
|---|---|---|---|
| 3,468,488 | 9/1969 | Karrer et al. | 241/37 |
| 3,835,766 | 9/1974 | Satake | 99/618 |
| 4,140,285 | 2/1979 | Linzberger et al. | 241/37 |

*Primary Examiner*—Philip R. Coe
*Assistant Examiner*—Timothy F. Simone
*Attorney, Agent, or Firm*—Burd, Bartz & Gutenkauf

[57] ABSTRACT

An apparatus for separating hulls from unhulled rice having a fixed rotating roll and a movable rotatable roll located in pressure contact with the fixed roll. A control rod connected to a biasing spring holds the movable roll in pressure contact with the fixed roll. An automatically operated control senses the biasing force of the biasing means and adjusts the biasing force to maintain substantially constant contact pressure between the fixed and movable rolls.

13 Claims, 6 Drawing Figures

FIG. 4
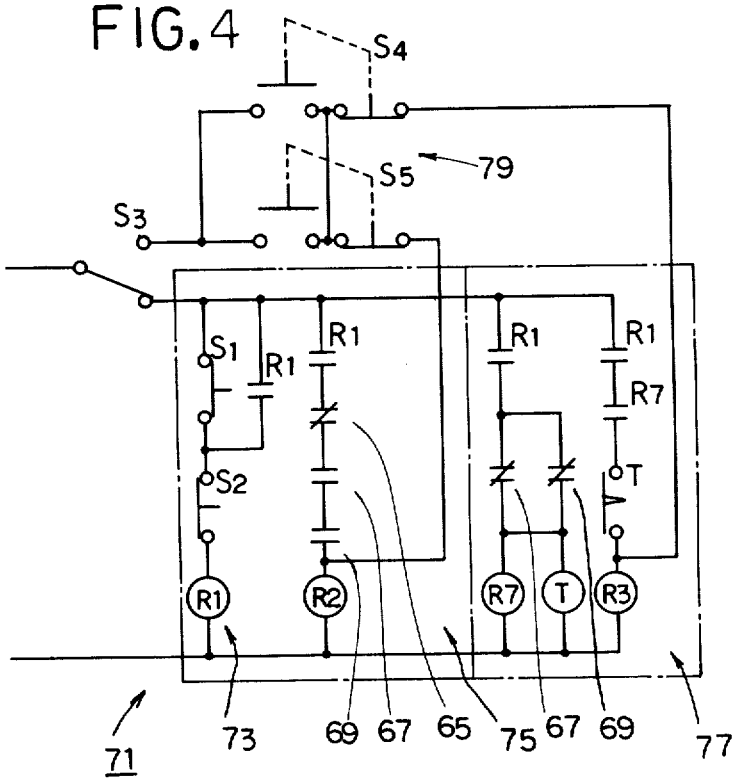
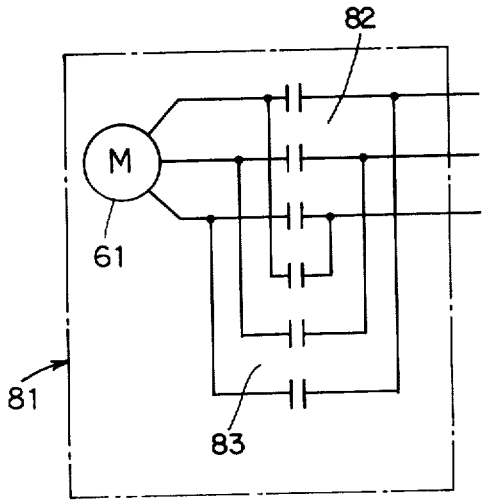
FIG. 5

AUTO-CONTROL EQUIPMENT OF HULL-REMOVING ROLL IN RICE-HULLING MACHINES

SUMMARY OF INVENTION

This invention is concerned with automatic equipment for a rice hull removing roll used in rice hulling machines. More particularly, the invention is directed to automatic control equipment for a traveling rice hull removing roll located in press contact with a fixed rice hull removing roll. The contact pressure of the traveling rice hull removing roll corresponds to the abrasion of the roll.

In use, rice hull removing rolls of a rice hulling machine become abrasive and wear. There is a gradual decrease of rice hull removing efficiency due to abrasion and wear of the hull removing rolls when the rolls are fixed relative to each other. The abrasion and wear on the rolls changes the rice hull removing pressure. Various measures have been taken to solve the change in hull removing pressure between pairs of hull removing rolls by making one roll movable. No efficient means have been suggested to date to compensate for roll wear and abrasion. The automatic control equipment of the invention has solved the problem of the compensating for roll wear and abrasion and maintaining rice hull removing efficiency.

The automatic control equipment of the invention improves the rice hull removing efficiency of the hull removing rolls by maintaining a pressure contact between the traveling rice hull removing roll and the fixed rice hull removing roll. This contact pressure is automatically maintained at a desired pressure.

DESCRIPTION OF DRAWINGS

FIG. 4 is a circuit diagram of the automatic controls for the traveling rice hull removing roll;

FIG. 5 is a circuit diagram of the servo-motor reversing control; and

DESCRIPTION OF PREFERRED EMBODIMENTS

Figure 1:
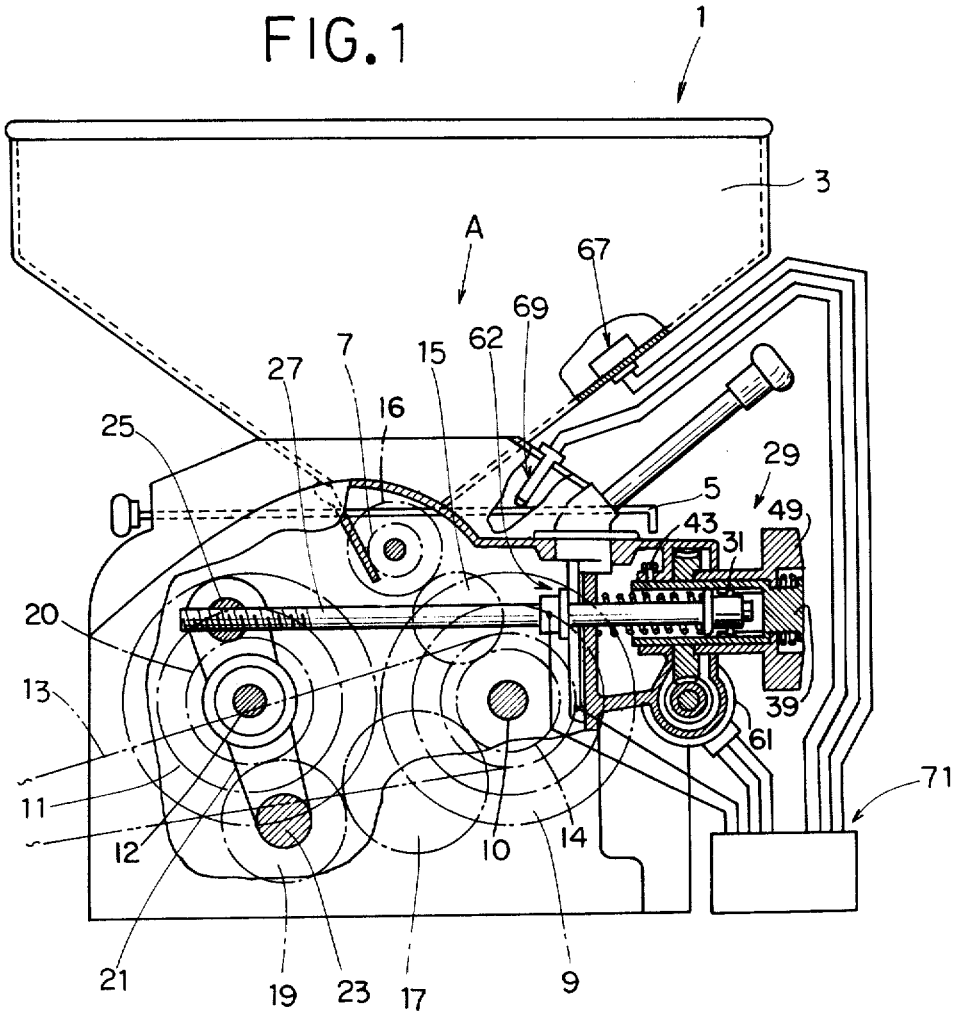
FIG. 1 is an end elevational view, partially sectioned, of a rice hulling machine equipped with the automatic control equipment of the invention for controlling the contact pressure between the traveling rice hull removing roll and the fixed rice hull removing roll.

Referring to FIG. 1, there is shown a sectional view of a rice hull machine 1 having a hopper 3 for accommodating rice. Hopper 3 has a bottom opening that is opened and closed with a movable shutter or door 5. An unhulled rice feeding roll 7 is located below the shutter 5 adjacent the bottom opening of hopper 3. A fixed rice hull removing roll 9 rotates about a longitudinal axis. An electric motor, not shown rotates the fixed rice hull removing roll 9. A traveling rice hull removing roll 11 is located laterally of the fixed rice hull removing roll 9. Power is transmitted from the fixed rice hull removing roll 9 to a gear 14 located in driving engagement with a gear 15. Gear 15 engages a gear 16 secured to the shaft of the feeding roll 7. The fixed rice hull removing roll 9 also drives the traveling rice hull removing roll 11 through gear 17 engageable with a gear 14 and gear 19 located in driving engagement with gear 17 and a gear 20 drivably connected to the roll shaft 12 and located in driving engagement with gear 19. Gear 19 is located in axial alignment with a shaft 23 carrying a generally upright arm 21. The mid-portion of arm 21 rotatably mounts shaft 12 of the traveling rice hull removing roll 11. A part 25, shown as a spherical member having threads accommodating a control rod 27, is mounted on the outer or free end of arm 21.

Figure 2:
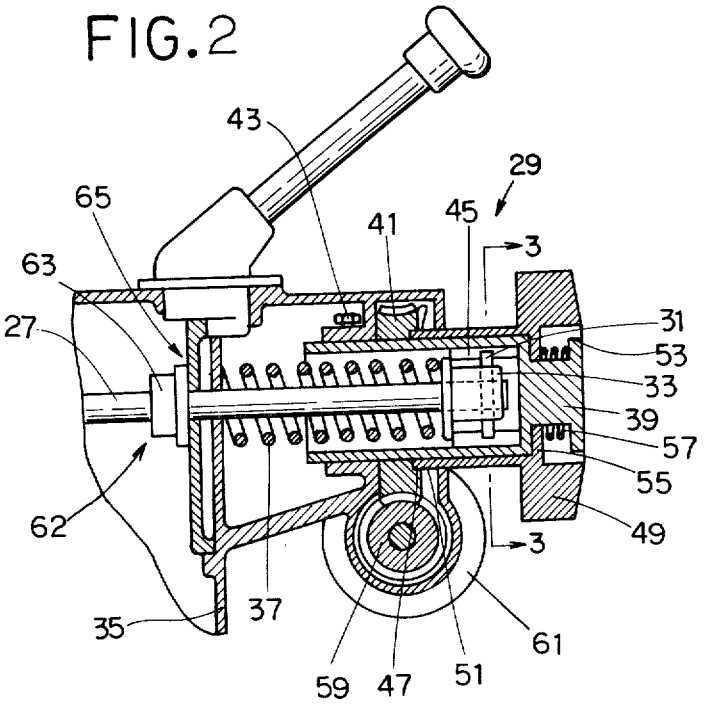
FIG. 2 is an enlarged sectional view of the control equipment shown in FIG. 1.
Figure 3:
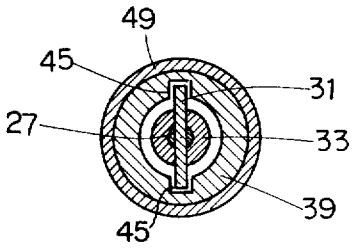
FIG. 3 is a sectional view taken along the line 3—3 of FIG. 2.

Rod 27 extends from gear part 25 to control equipment indicated generally at 29 operable for automatically controlling the contact pressure between rice removing rolls 9 and 11. Referring to FIGS. 2 and 3, control equipment 29 is mounted on machine frame 35. The rear part of control rod 27 extends into control equipment 29. A metal sleeve 33 is mounted on the rear end of control rod 27 and retained thereon with a transverse projection or pin 31. A coil spring 37 surrounding the rear end of control rod 27 is interposed between sleeve 33 and machine frame 35 to bias control rod 27 in an outward direction.

A hand holder cup-shaped member 39 rotatably accommodates a worm wheel 41. Worm wheel 41 bears against a portion of the machine frame and is freely rotatable relative to the machine frame 35. As shown in FIG. 3, member 39 has inside axial grooves 45 accommodating opposite ends of pin 31. A bolt 43 can be used to lock cup-shaped member 39 to machine frame 35. The outside of worm wheel 41 has an annular recess 47. A control handle 49 having a cylindrical portion is rotatably mounted on the member 39. The cylindrical portion of control handle 49 has an inside end or tip part 51 that fits into annular recess 47 thereby securing part 51 to wheel 41.

Member 39 has a radially outwardly directed flange or projection 53 axially spaced from an inwardly directed flange or projection 55 on control handle 49. A spring 57 is interposed between flanges 53 and 55. Spring 57 biases the annular end or tip 51 of control handle 49 into engagement with the side of worm wheel 41.

A worm 59 is drivably associated or interlocked with worm wheel 41. A servo-motor 61 operates to rotate worm 59 thereby rotating worm wheel 41. Control rod 27 is equipped with a suspending mechanism indicated generally at 62. The suspending mechanism 62 consists of machine frame 35 suspending member 63 in contact with machine frame 35 and spring 37. Spring 37 is a pressure adding device. When control rod 27 is pulled against the biasing force of spring 37 in the left direction, as shown in FIGS. 1 and 2, member 63 moves away from machine frame 35 leaving a space or opening. A detector 65 isolates the suspending member 63 from machine frame 35. Detector 65 senses the movement of suspending member 63 relative to fixed machine frame 35. Detector 65 can be a microswitch, photoelectric switch, or differential transformer.

As shown in FIG. 1, an unhulled rice detector 67 is mounted in the inside of hopper 3. Detector 67 can be a limit switch. Detector 67 senses the presence of unhulled rice in hopper 3 without supplying unhulled rice to the space between the rice hull removing rolls 9 and 11.

A shutter change-over detector 69, such as a limit switch, is mounted on machine frame 35 over door 5.

Automatic control equipment indicated generally at 71 provides an energy source for driving servo-motor 61 in forward and reverse directions in accordance with the state of output of the control equipment 71. The control equipment 71 responds to signals from the shutter change-over 69, opening detector 65, and unhulled rice detector 67.

As shown in FIG. 4, automatic control equipment 71 comprises a starting and stopping control 73 and controls 75 and 77. Control 75 is operable to maintain a substantially constant pressure between the traveling rice hull removing roll 11 and the stationary rice hull removing roll 9. Disconnecting or releasing control 77 is operable to move the traveling rice hull removing roll 11 a certain extent or distance in a pressure releasing direction away from the fixed rice hull removing roll 9. Opening control 79 includes a manual switch for adjusting the opening or space between the traveling rice hull removing roll 11 and fixed rice hull removing roll 9. As shown in FIG. 5, servo-motor 61 has control unit 81 for controlling the forward and reverse directions of operation of the motor.

The starting and stopping control 73 comprises starting switch S1, stopping switch S2, and relay R1.

When starting switch S1 is depressed, relay R1 is energized and remains energized until stopping switch S2 is depressed. When stopping switch S2 is depressed, relay R1 is de-energized and remains de-energized until the starting switch S1 is depressed.

Control 75 includes relay R1, opening detector 65, door switch 69, and relay R2. Detector 65 is in a contact or closed position when suspending mechanism 62 is not spaced from the frame 35. Unhulled rice detector 67 is closed when there is unhulled rice in hopper 3. Door detector 69 is in the closed state when door 5 is open. Relay R2 is energized when relay R1 is energized, and detectors 65, 67, and 69 are closed.

Releasing control 77 comprises unhulled rice detector 67 and door detector 69. The traveling releasing control 77 also includes the unhulled rice detector 67, door detector 69, time adjusting relay T, and relays R1, R3, and R7.

Relay R7 and time adjusting relay T are energized when no rice is detected in hopper 3 by unhulled rice detector 67 and when the closed state of door 5 is detected by door detector 69. Relay R3 is energized when time adjusting relay T is closed in response to the energization of relays R1 and R7. Relay R7 and time adjusting relay T are simultaneously energized and the contact point of relay T is in the closed state after a period of time. The energized state of relay R7 and the closed state of the contact point of time adjusting relay T are achieved after the passing of a period of time commencing after the simultaneous energization of both relay R7 and relay T.

The manually controlled equipment 81 for open control 79 consists of a plurality of manual switches S3, S4, and S5. Switch S3 is a change-over switch operable by manual switches S4 and S5. When manual switch S3 is connected with the upper terminal, relay R2 is energized by depressing manual switch S4.

Relay R3 is energized by depressing manual switch S5.

Referring to FIG. 5, there is shown the forward and reverse control for servo-motor 61 indicated generally at 81. Control 81 comprises a pair of relays 82 and 83 connected in parallel to the three conductors leading to servo-motor 61. When relay 82 is energized, servo-motor 61 rotates in a forward, normal direction. When relay 83 is energized, the servo-motor 61 rotates in a reverse direction. Rotation of servo-motor 61 is transferred to control rod 27 through worm 59, worm wheel 41, control handle 49, and member 39 thereby rotating rod 27. The rotating rod, being threaded into part 25, pivots the arm about the axis 23 of gear 19. This controls the opening or space between the traveling rice hull removing roll 11 and the fixed rice hull removing roll 9.

Returning to FIG. 4, manual switch S3, when changed to the lower contact point and starting switch S1, is closed and relay R1 is energized and kept in the energized state. The closed state of relay R1 is maintained by the operation of releasing controls 77 and control 75. The unhulled rice in hopper 3 is detected by unhulled rice detector 67.

The opened state of door 5 is detected by detector 69 and when the space or opening associated with suspending mechanism 63 is not detected by detector 65, relay R2 is energized and servo-motor 61 rotates in its normal or forward direction. The forward rotation of servo-motor 61 is transferred to worm 59, worm wheel 41, control handle 49, and holder 39 causing rod 27 to rotate in a direction which moves arm 21 and traveling roll 11 into pressure engagement with fixed roll 9. This operation continues as long as there is a space or opening between the hull removing rolls 9 and 11. When traveling hull removing roll 11 contacts the fixed hull removing roll 9, stress is added to control rod 27, as arm 21 is not free to pivot as it is biased by spring 37. This causes suspending mechanism 62 to sense a space or opening. When this space is detected by detector 65, relay R2 is de-energized and servo-motor 61 stops. This stops the movement of the traveling rice hull removing roll 11. The automatic control does not operate to exert an excessive pressure by traveling roll 11 against fixed roll 9.

During the rice hulling operation, the rice hull removing rolls 9 and 11 wear by the process of abrasion. The control rod 27 moves to the right, as shown in FIGS. 1 and 2, closing the opening between the suspending mechanism 62 and opening detecting equipment 65. The opening detecting equipment is in a closed state. Servo-motor 61 is driven to normally rotate the worm 59 and worm gear 41, thereby rotating the control rod 27 to automatically control the position of pressure of rice hull removing roll 11 against the rice hull removing roll 9. When no unhulled rice in hopper 3 is detected by detector 67 or the closed state of shutter 5 is detected by detector 69, relay R2 is de-energized. Relay R7 and time adjusting relay T of releasing control 77 are energized thereby energizing relay 83 for a period of time after energization of relay R7 and time adjusting relay T. After energization of relay 83 for a predetermined period of time, servo-motor 61 is operated in a reverse direction.

The reverse rotation of servo-motor 61 is transferred to control rod 27 via worm 59, worm gear 41, and control handle 49. This moves operating arm 21 to the left, as shown in FIG. 1, releasing the pressure of traveling rice hull removing roll 11 against the fixed rice hull removing roll 9. This operation provides for a proper space or opening between the rice hull removing rolls 9 and 11. Suspending mechanism 62 is not limited or restricted during the reverse operation of servo-motor 61.

Figure 6:
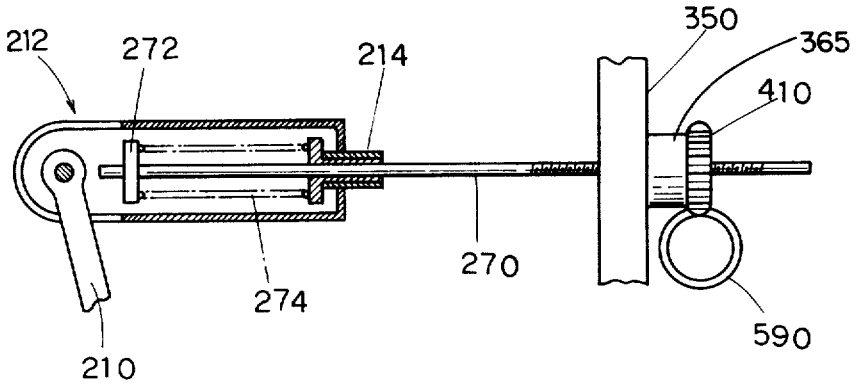
FIG. 6 is a sectional view of a modification of the control equipment.

Referring to FIG. 6, the outer end of arm 210, operatively connected to the traveling rice hull removing roll 11, pivotally supports one end of a connecting member indicated generally at 212. The other end of connecting member 212 is coupled with the spring control member 214. A control rod passes through the center of spring control member 214 and is slidably disposed therein.

One end of control rod 270 carries a body 272. A compression spring 274 is located between the member 214 and body 272 to bias the connecting member to the left.

A worm wheel 410 is geared to the control rod 270. The worm wheel is rotated with worm 590 operatively connected in driving relation to servo-motor 61. Worm wheel 410 is rotatably supported on the machine frame 350. Space detector 365 is interposed between frame 350 and worm gear 410.

In use, rotation of servo-motor 61 rotates control rod 270 to move the rod to either the right or the left, depending on the direction of rotation of servo-motor 61. The space between the rice hull removing rolls 9 and 11 is adjusted by movement of the connecting member 212 and arm 210. When there is no space or opening between arm 210 and the end of control rod 270, the traveling rice hull removing roll 11 is in contact with the fixed rice hull removing roll 9. The contact pressure between the rolls 9 and 11 is determined by the operating characteristics of the detector 365.

Automatic control of the rice hull removing pressure between the rolls 9 and 11 is maintained by the space or opening detector 365.

The spring 37, as shown in FIG. 2, and the spring 274, as shown in FIG. 6, can be replaced with a biasing means that utilizes hydraulic fluid pressure or air pressure.

In assembly, the space detector 65 and 365 controls the contact pressure of the traveling rice hull removing roll 11 with respect to the fixed rice hull removing roll 9. This contact pressure is maintained substantially constant, regardless of the abrasion or wear of the rolls 9 and 11. A stable rice hulling operation is maintained so as to remarkably elevate the rice hull removing efficiency.

We claim:

1. An apparatus for separating hulls from unhulled rice comprising:

a hopper for accommodating unhulled rice, said hopper having a bottom opening for discharge of unhulled rice, a first roll rotatable about a longitudinal axis below said opening, a second roll located adjacent said first roll and rotatable about a longitudinal axis generally parallel to the longitudinal axis of the first roll, said second roll engaging said first roll below said bottom opening of the hopper, drive means for rotating the first and second rolls in opposite directions whereby the hulls and rice are separated from unhulled rice delivered to said first and second rolls from said hopper bottom opening, first means mounting said second roll for general lateral movement toward and away from said first roll, second means for yieldably biasing the first means in a direction to move said second roll toward said first roll, third means for sensing the contact pressure between the first and second rolls, and fourth means responsive to said third means for moving said second roll toward said first roll and maintaining a substantially constant contact pressure between said first and second rolls.

2. The apparatus of claim 1 including: a feeding roll located adjacent the bottom opening and drive means for rotating the feeding roll whereby the feeding roll moves unhulled rice from the bottom opening toward the first and second rolls.

3. The apparatus of claim 2 including: door means movably mounted on the hopper operable to selectively open and close the bottom opening.

4. The apparatus of claim 1 wherein: the first means comprises arm means, means rotatably mounting the second roll on said arm means, and means pivotally mounting the arm means allowing the second means to bias the second roll into pressure contact with the first roll.

5. The apparatus of claim 4 wherein: the arm means has a free end, and the second means includes a rod having an end threaded onto the free end of the arm means, and biasing means engageable with the rod for moving the rod in a direction to bias the second roll into pressure contact with the first roll.

6. The apparatus of claim 5 wherein: the third means includes means to adjust the biasing force of the biasing means.

7. The apparatus of claim 5 wherein: the third means includes means to sense the biasing force and means responsive to the sensed biasing force to operate the means to adjust the biasing force in a manner to maintain a substantially constant biasing force.

8. The apparatus of claim 7 wherein: the third means includes a suspending member connected to the rod and a non-suspending member, the means to sense the biasing force includes a detector for detecting a space between the suspending member and the non-suspending member.

9. The apparatus of claim 1 wherein: the third means includes means to sense the biasing force of the second means and means to adjust the biasing force of the second member in a manner to maintain a substantially constant contact pressure between said first and second rolls.

10. The apparatus of claim 1 wherein: the second means includes a rod and biasing means engageable with the rod for moving the rod in a direction to bias the second roll into pressure contact with the first roll.

11. The apparatus of claim 10 including: means to adjust the biasing force of the biasing means.

12. The apparatus of claim 11 wherein: the third means includes means to sense the biasing force and said fourth means is responsive to the sensed biasing force to operate the means to adjust the biasing force in a manner to maintain a substantially constant biasing force.

13. The apparatus of claim 12 wherein: the third means includes a suspending member connected to the rod and a non-suspending member, and the means to sense the biasing force includes a detector for detecting a space between the suspending member and the non-suspending member.

* * * * *